US005282579A

United States Patent [19]

Poser et al.

[11] Patent Number: 5,282,579

[45] Date of Patent: Feb. 1, 1994

[54] APPARATUS FOR ADJUSTING THE GAP OF A SIZE REDUCTION MACHINE

[76] Inventors: Kimberly J. Poser, 122 Edgehill Drive, Kitchener, Ontario, Canada, N2G 3W6; Benjamin K. Murugesu, 47, Florenc Ave., Kitchener, Ont., Canada, N2A 2K7

[21] Appl. No.: 8,250

[22] Filed: Jan. 25, 1993

[51] Int. Cl.[5] ..... B02C 23/16; B02C 25/00

[52] U.S. Cl. ..... 241/69; 241/74; 241/89.1; 241/101.3; 73/1 J

[58] Field of Search ..... 241/69, 74, 89.1, 101.3; 73/1 J

[56] References Cited

U.S. PATENT DOCUMENTS

| | | | |
|---|---|---|---|
| 1,515,113 | 11/1924 | Holmquist et al. | 241/89.1 |
| 2,840,318 | 6/1958 | Schnell | 241/89.1 |
| 3,149,791 | 9/1964 | Richelmann | 241/101.3 |
| 3,750,618 | 8/1973 | Griebenow | 82/137 |
| 4,759,507 | 7/1988 | Lynch et al. | 241/69 |

*Primary Examiner*—Mark Rosenbaum
*Assistant Examiner*—John M. Husar
*Attorney, Agent, or Firm*—Jeffrey T. Imai; Arne I. Fors; Doak D. Horne

[57] ABSTRACT

An extensible spacer device for setting a gap between an impeller and a screen of a size reduction machine comprises a first collar having an axially extending bore, an internal thread on an inside surface of the bore and a circumferential shroud extending axially, a second collar having a base portion, a barrel portion and an axially bore extending therethrough. The barrel portion has an external thread adapted to threadingly engage the internal thread. The shroud is adapted to cover the barrel portion and frictionally engage the base portion when the first collar threadingly engages the second collar. A calibrated scale is on the base portion and a plurality of gradations circumferentially extends about the shroud to indicate an axial length of the spacer device as the first collar is rotated relative to the second collar.

11 Claims, 4 Drawing Sheets

42
20
32
44
12
34
38
40
48
40
36
52
14
46

50
70
56
54

56
16
98
64
30
26
18
24
62
28
60
62
58
62
22

APPARATUS FOR ADJUSTING THE GAP OF A SIZE REDUCTION MACHINE

FIELD OF INVENTION

This invention relates to a size reduction machine and in particular an extensible spacer device for adjusting the size of the gap between an impeller and a screen.

BACKGROUND OF THE INVENTION

Size reduction machines of the prior art utilise a frusto-conical shaped screen located in a channel between an input and an output. Such size reduction machines are more particularly described in U.S. Pat. No. 4,759,507. In these machines, various screens and impellers are used depending on the size and type of product that is being processed. The screens have apertures in different sizes and shapes to produce a desired milled product.

Once a screen and impeller have been selected, the operation and efficiency of the machine depends upon the gap between the impeller and the interior wall surface of the screen. The different wall thicknesses of the screen are compensated for by inserting or removing spacers on the impeller shaft to move the impeller relative to the interior wall surface of the screen. Since the wall of the screen is tapered relative to the impeller, the actual adjustment of the gap is less than the thickness of the spacer and depends upon the angle of the screen relative to the horizontal. Where the tapered wall of the screen has an angle of sixty degrees relative to the horizontal, the gap is adjusted by one half the thickness of the spacer.

The adjustment of the gap becomes more complicated when it is desired to use a new screen having a different wall thickness and at the same time varying the gap size. It is thus necessary to remove or insert spacers on the impeller shaft whenever a screen having a different wall thickness from the previous screen is used in the machine.

For each set of screen and impellers, a variety of spacers must be provided with the machine. In order to arrive at the proper spacing between the impeller and the screen, the impeller must be installed with a first spacer. If the impeller rubs against the screen, the impeller must be removed to remove the first spacer and replace it with a second incrementally smaller spacer. The process is repeated until there is no metal to metal contact between the impeller and the screen.

Alternatively, if the impeller does not rub against the screen, the steps are repeated with incrementally thicker spacers. The process is repeated until contact is heard whereupon the next incrementally smaller spacer replaces the previous spacer establishing the proper gap setting.

The gap between the impeller and the screen is critical for producing a final milled product of consistent particle size. If the gap is too large, there is a loss of capacity or throughput, screen binding and a change in particle size. If no gap exists between the impeller and the screen, the screen and the impeller will become worn or burned and in the extreme, the impeller will not rotate.

The use of spacers is mandatory to produce satisfactory results for consistent particle size of milled product. However, the calibration process of installing a spacer and repeatedly removing and replacing incremental spacers is time consuming. Further, since the spacers must be incrementally sized and machined, the cost of producing such spacers is relatively high. Spacers are easily lost during cleaning which can lead to re-assembly of the size reduction machine with an improper gap setting and decreased performance.

When more than one spacer is used to achieve the proper gap setting, narrow gaps or machine crevices are created. These gaps or crevices are to be avoided in sanitary applications of the size reduction machine.

Maintaining the gap between the impeller and the screen is imperative for maintaining a consistent particle size of the milled product. Therefore it is essential that the impeller be fixed relative to the screen during operation. Spacers have been found to be well suited for this application since the spacer will not measurable vary during operation of the size reduction machine.

Adjustable spacer means have been proposed to replace the spacers. Such a device is illustrated in U.S. Pat. No. 4,759,507. The apparatus of the prior art mounts the spindle within a housing which threadably engages the machine housing. By rotating the spindle housing relative to the machine housing, the spindle and the impeller move relative to the screen for adjustment of the gap. However, since the spindle receives the drive for rotation thereof via a series of belts and pulleys, relative displacement of the spindle requires relative displacement of the drive motor to maintain alignment between the drive motor and the pulley mounted on the spindle. The additional adjustment not only increases the time for calibrating the apparatus and ultimately the cost for designing and using the apparatus, different personnel may be required to undertake the adjustment of the drive motor.

The use of threads to provide a method of adjusting the gap has traditionally been unacceptable for use in a size reduction machine. Size reduction machines are widely used in sanitary environments. For example, the production of pharmaceuticals and cosmetics require very strict sanitary standards for operation and production. It is difficult to adequately clean between the threads if the threaded portion is not removable from the machine. Accordingly, the pharmaceutical industry has rejected any machines which are not capable of being fully sanitized.

SUMMARY OF THE INVENTION

The disadvantages of the prior art may be overcome by providing a size reduction machine where the size of the gap between the impeller and the screen may be adjusted without the use of fixed spacers.

It is desirable to provide a device which is extensible to space the impeller along a rotatable shaft to size the gap between the impeller and the screen.

It is still further desirable to provide an extensible spacer device which has a calibrated scale to show the relative axial length of such device.

According to one aspect of the invention, there is provided a size reduction machine for use in process industries for continuously and precisely reducing the size of particles, while controlling fines. The size reduction machine comprises an impeller mounted on a rotatable shaft. A motor is operably connected to the shaft for effecting rotation of the shaft. The shaft and impeller are mounted within a channel having an input and an output. A screen has a tapered apertured wall formed in a frusto-conical shape, with a wide end of the screen being open and a circular flange surrounding and extending outwardly of the wide end. The screen is rigidly mounted within the channel so that any particles passing from the input to the output pass through the screen. The impeller is shaped and mounted so that there is a gap between the edge of the impeller and an interior of the screen, which gap remains substantially constant as the impeller rotates relative to the screen. The shaft has an impeller receiving end. The receiving end has a diameter adapted for receiving the impeller and has a shoulder. The receiving end has an axially extending threaded bore. An extensible spacer for positioning the impeller along the receiving end is mounted on the receiving end between the shoulder and the impeller. The extensible spacer comprises a first collar threadably engaging a second collar whereby an axial length of said spacer device is varied as said first collar is rotated relative to said second collar. A bolt engages the threaded bore for releasably fastening the spacer between the impeller and the shoulder.

According to another aspect of the invention there is provided an extensible spacer device for setting a gap between an impeller and a screen of a size reduction machine. The spacer device comprises a first collar having an axially extending bore, an internal thread on an inside surface of the bore and a circumferential shroud extending axially, a second collar having a base portion, a barrel portion and an axially bore extending therethrough. The barrel portion has an external thread adapted to threadingly engage the internal thread. The shroud is adapted to cover the barrel portion and frictionally engage the base portion when the first collar threadingly engages the second collar. A calibrated scale is on the base portion and a plurality of gradations circumferentially extends about the shroud to indicate an axial length of the spacer device as the first collar is rotated relative to the second collar.

DETAILED DESCRIPTION OF THE DRAWINGS

In figures which illustrate embodiments of the invention,

DETAILED DESCRIPTION OF THE INVENTION

Figures 1, 5, 6:
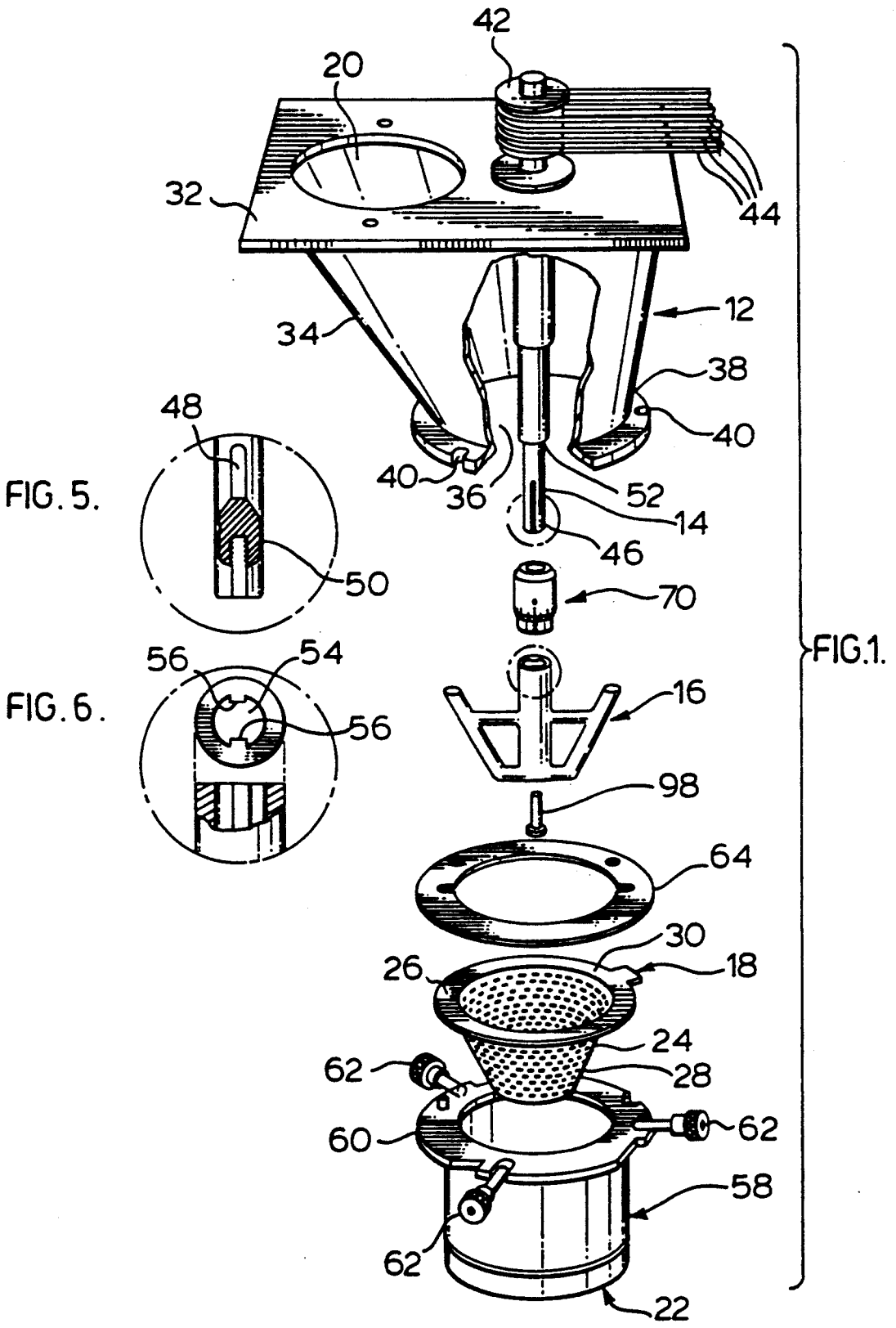
FIG. 1 is an exploded perspective view of the size reduction machine incorporating the invention.
FIG. 5 is an elevational view of the receiving end of the shaft, partially in section, of the size reduction machine of FIG. 1.
FIG. 6 is an elevation view, partially in section, and top plan view of the mating end of the impeller of the size reduction machine of FIG. 1.
Figure 2:
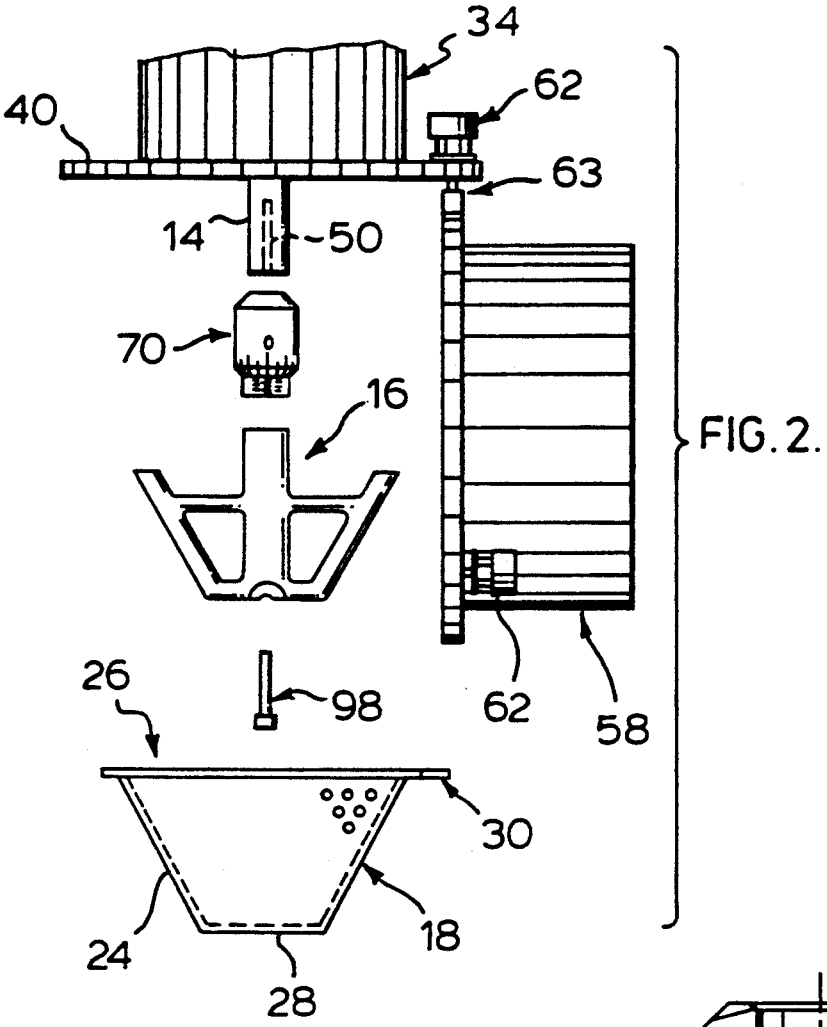
FIG. 2 is an exploded elevational view of the size reduction machine of FIG. 1.

The size reduction machine incorporating the present invention is illustrated in FIG. 1. The machine generally has a housing 12, a spindle 14, an impeller 16 and a screen 18.

The spindle 14 and impeller 16 are located in a channel having an input 20 and an output 22. Screen 18 has a tapered apertured wall 24 formed into a frusto-conical shape with a wide end 26 and a narrow end 28. End 26 is open while end 28 is at least partially closed. The screen 18 has a circular flange 30 which surrounds and extends outwardly of the wide end 26.

Housing 12 has a top cover plate 32 having input 20 offset to one side of the housing 12. Immediately below the top cover plate 32 is a wall 34 defining the channel for passing particles to be milled. Wall 34 converges to a circular opening 36. The circumference of circular opening 36 has an outwardly extending flange 38 having a plurality of circumferentially spaced notches 40.

Spindle 14 is rotatable mounted on top cover plate 32 using conventional bearings and mounts. The spindle 14 extends longitudinally through housing 12 defining an axial extent. The axis of rotation of spindle 14 is concentric with the centre of the circular opening 36. Spindle 14 extends upwardly from the top cover plate 32 to present a shaft for receiving pulleys 42 adapted to be driven by belts 44 from a suitable drive (not illustrated).

The receiving end 46 of shaft 14 has diametrically opposed machined surfaces 48. The remote end of receiving end 46 has an axially extending threaded bore 50. The upper end of receiving end 46 has a shoulder 52. Receiving end 46 is adapted to receive impeller 16.

Impeller 16 has an axially extending central aperture 54. Central aperture 54 has complementary abutments 56 for mating with receiving end 46 of spindle 14. Although machined surfaces 48 and abutments 56 have been described, any type of engagement surfaces, such as keyways, splines, etc., may be used provided rotational drive can be effectively transmitted from the spindle 14 to the impeller 16.

Shroud 58 has an opening at either end with a circular flange 60 surrounding the opening at the upper end. Flange 60 has a plurality of bolts 62 attached to hinges 63 for pivotal attachment thereto. The bolts 62 are circumferentially spaced about the flange 60 to mate with notches 40 of flange 38 of housing 12. Gasket 64 is adapted to seal the joint between flanges 38 and 60.

Figure 3:
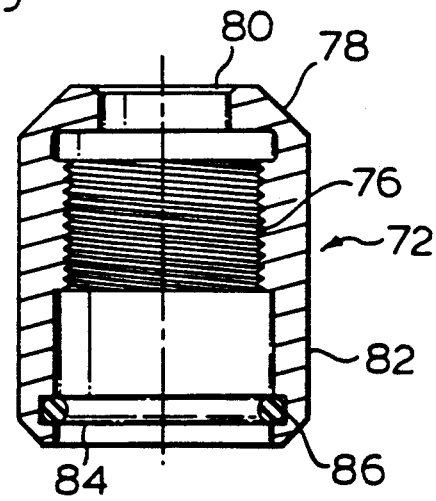
FIG. 3 is a sectional view of one of the collars of spacing device of present invention.
Figure 4:
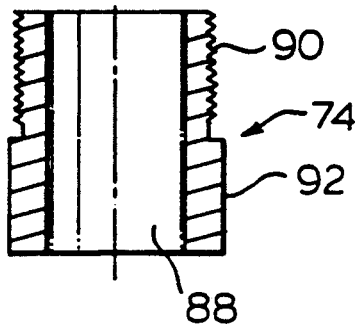
FIG. 4 is a sectional view of the other of the collars of spacing device of present invention.

The extensible spacer device of the present invention is illustrated as 70 and particularly illustrated in FIGS. 3 and 4. The spacer device 70 comprises of a collar 72 and collar 74. Collar 72 has a central bore having an internal thread 76. The diameter of the central bore is greater than the outside diameter of the spindle. The upper end of collar 72 has an end seal portion 78 presenting an opening 80. Opening 80 has a diameter within very close tolerances with the outside diameter of the spindle 14. Collar 72 has a shroud 82 extends axially defining an internal bore. The inner face of the lower end of shroud 82 has a ring groove 84 adapted to receive an O-ring 86.

Collar 74 has a central bore 88 extending axially. The central bore 88 has a diameter within very close tolerances with the outside diameter of the spindle 14. Collar 74 has an external thread 90 cut on a barrel portion. Thread 90 is adapted for threaded engagement with internal thread 76 of collar 72. Collar 74 has a base portion 90 having an external diameter. The external diameter of base 90 is within close tolerances with the inside diameter of the internal bore of shroud 82. As is apparent, collar 74 will fit within collar 72 with O-ring 86 sealing the threaded portion from penetration by or intrusion of particles during operation.

Figure 7:
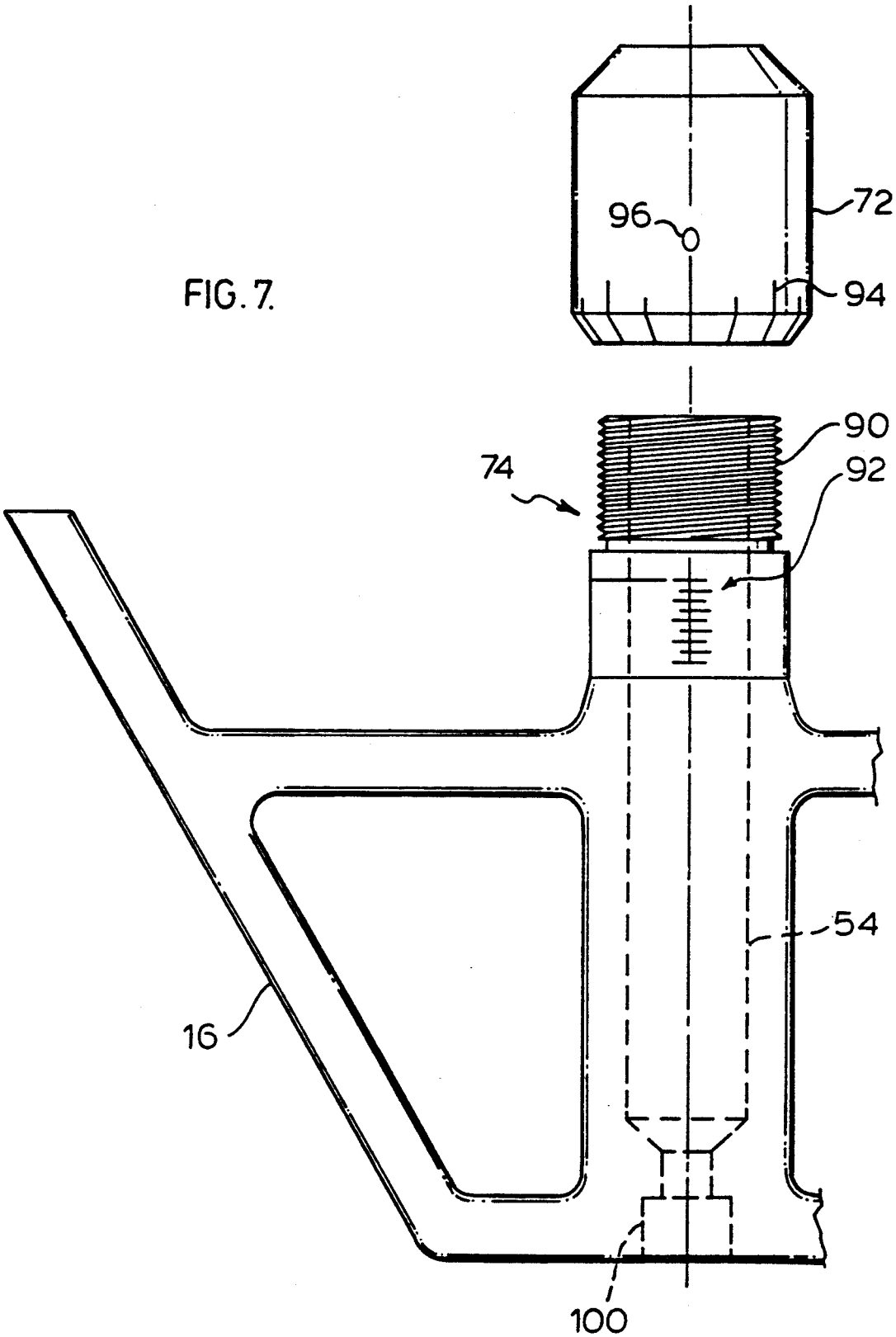
FIG. 7 is a partial elevational view of the impeller and spacing device of the size reduction machine of FIG. 1.

Referring to FIG. 7, the base of collar 74 has a calibrated scale 92 on an external face. The outer circumferential surface of collar 72 has a series of gradations 94 and a zero marking 96. The scale 92 and gradations 94 relate to the type and coarseness of the thread 90. Rotation of collar 72 relative to collar 74 will advance or detract collar 74, varying the axial length of spacer device 70. The scale 92 and gradations 94 are selected according to type of thread. A standard micrometer relationship between the rotation of the collar and the extension distance of spacer 70 is used.

In the preferred embodiment, a thread of 12 threads/inch (2.54 cm) Unified National Fine (UNF) is used. The thread is a V-shaped thread. However, it is readily apparent that a square thread or other types of threads may be used. Further, metric threads could also be used to convert the scale 92 and gradations 94 to metric units.

To assemble the spacer device 70, O-ring 86 is seated within ring groove 84. Collar 72 is presented to collar 74 and threadingly engaged.

To assemble the size reduction machine, spacer 70 is presented to spindle 14, followed by impeller 16. Bolt 98 is presented to counter bore 100 of impeller 16 to engage threaded bore 54 of spindle 14. Collar 72 is rotated relative to collar 74 until the spacer is set at a predetermined setting which is directly related to the axial length of the spacer device. Bolt 98 is tightened, urging impeller 16 against spacer 70 against shoulder 52. End seal portion 78 forms a metal to metal seal with shoulder 52 of spindle 14 substantially preventing particles from entering the interior of spacer 70. Spacer 70 is releasably fastened, fixing the gap between the impeller and screen.

The corresponding screen 18 is selected and placed in shroud 58. Gasket 64 is placed circumferentially over the wide end of screen 18 and presented to flange 38 of housing 12. Bolts 62 are pivoted and introduced into notches 40 to releasably attach the shroud 58 to the housing.

In use, product to be milled is introduced into input 20. The product falls through housing 12, past the rotating impeller 16, through screen 18 and downwardly through shroud 58 to exit through output 22.

To change the gap setting, the shroud 58 is removed exposing the impeller 16. Bolt 98 can be loosened, allowing relative rotational movement between the collars 72 and 74, setting the axial length of the spacer 70. Bolt 98 can re-tightened and the shroud replaced. The size reduction machine is ready for use.

It is apparent that the screen and gap setting may be easily replaced by a single operator. A further advantage of the present invention is that the space may be disassembled and the cleaned. The threads may be cleaned using a scrub brush to remove any particles which may pass the O-ring 86 or the metal to metal contact at end seal portion 78. This feature is critical when the size reduction machine is used in a sanitary environment.

Figure 8:
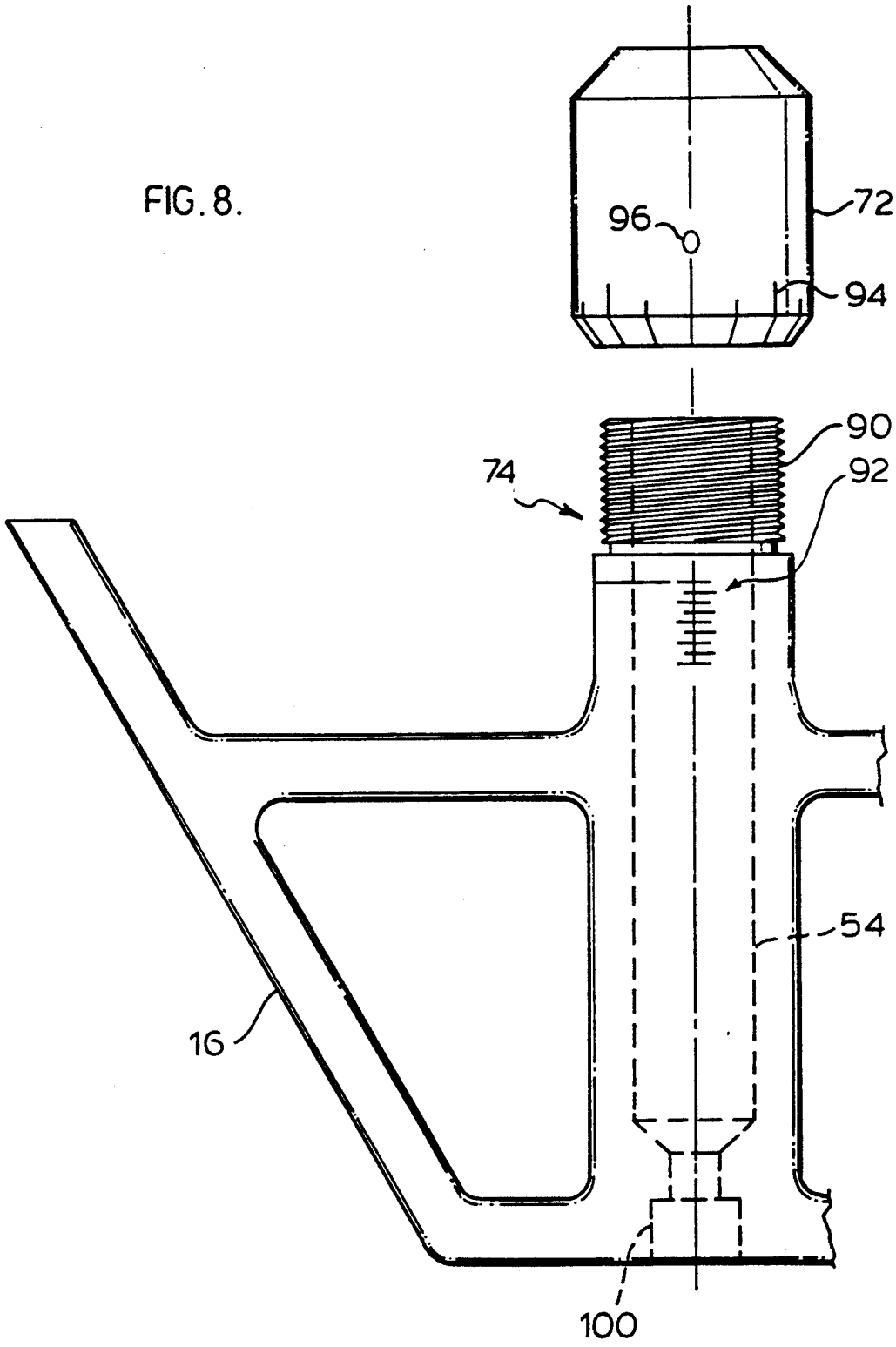
FIG. 8 is a partial elevational view of the impeller and spacing device according to a second embodiment of the invention.

In a second embodiment of the invention, collar 74 is manufactured integral with the impeller 16, as illustrated in FIG. 8.

While the invention herein has been described in connection with exemplary embodiments, it will be understood that many modifications will be apparent to those skilled in the art.

We claim:

1. A size reduction machine for use in process industries to continuously and precisely reduce the size of particles, while controlling fines, said machine comprising an impeller mounted on a rotatable shaft, a motor operably connected to said shaft for effecting rotation of said shaft, said shaft and impeller being mounted within a channel having an input and an output, a screen having a tapered apertured wall formed in a frusto-conical shape, with a wide end of said screen being open, a circular flange surrounding and extending outwardly of said wide end, said screen rigidly mounted within said channel so that any particles passing from said input to said output pass through said screen, said impeller being shaped and mounted so that a gap between an edge of said impeller and an interior of said screen remains substantially constant as said impeller rotates relative to the screen, said shaft having an impeller receiving end, said receiving end having a diameter for receiving said impeller terminating at a machined shoulder, said receiving end having an axially extending threaded bore and a bolt for releasably fastening said impeller to said shaft, wherein the improvement comprises an extensible spacer means for positioning the impeller along said receiving end for determining said gap, said spacer means mounted on said end shaft portion between said shoulder and said impeller, said spacer means comprising a first collar having an external thread threadably engaging a second collar having an internal thread whereby an axial length of said spacer means is varied as said first collar is rotated relative to said second collar, said first collar having one end machined for sealing abutting with said shoulder and a shroud extending opposite said one end, said second collar having a base portion and a barrel portion extending therefrom, said barrel portion having said external thread, said shroud extending over said external thread to said base portion, said spacer means having a sealing means for sealing said shroud with said base portion whereby said internal thread and external thread are enclosed as said axial length is varied, substantially preventing particles from intruding into said spacer means as particles pass from the input to the output, and said bolt engaging said threaded bore releasably fastening said spacer means between said impeller and said shoulder locking said first collar relative to said second collar.

2. A size reduction machine as claimed in claim 1 wherein said spacer means includes a calibrated scale to show the axial length of said spacer means.

3. A size reduction machine as claimed in claim 2 wherein said second collar has a calibrated scale and said shroud has a plurality of gradations in a micrometer relationship with said calibrated scale.

4. A size reduction machine as claimed in claim 1 wherein said sealing means is an O-ring extending about said base portion.

5. A size reduction machine as claimed in claim 4 wherein said shroud has a groove extending about an inside surface thereof and adapted for receiving said O-ring.

6. An extensible spacer device for setting a gap between an impeller and a screen of a size reduction machine adapted to continuously and precisely reduce the size of particles, while controlling fines, said extensible spacer device comprising a first collar having an axially extending bore and an internal thread on an inside surface of said bore, said first collar having a circumferential shroud extending axially and one end adapted for sealingly abutting with a shoulder on a spindle of said size reduction machine, a second collar having a base portion, a barrel portion and an axially bore extending therethrough, said barrel portion having an external thread adapted to threadingly engage said internal thread, an axial length of said spacer device is varied as said first collar is rotated relative to said second collar, said shroud adapted to cover said barrel portion and sealingly engage said base portion when said first collar threadingly engages said second collar, whereby said internal thread and external thread are enclosed, substantially preventing particles from intruding into said spacer device, a calibrated scale on said base portion and a plurality of gradations circumferentially extending about said shroud to indicate the axial length of said spacer device as said first collar is rotated relative to said second collar.

7. An extensible spacer device as claimed in claim 6 wherein said device includes an O-ring extending about said base portion between said base portion and said shroud.

8. An extensible spacer device as claimed in claim 7 wherein said shroud has a groove extending about an inside surface thereof and adapted for receiving said O-ring.

9. An extensible spacer device as claimed in claim 6 wherein one of said first and second collars is integral with the impeller.

10. An extensible spacer device as claimed in claim 9 wherein said sealing means is an O-ring extending about said base portion between said base portion and said shroud.

11. An extensible spacer device as claimed in claim 10 wherein said shroud has a groove extending about an inside surface thereof and adapted for receiving said O-ring.

* * * * *